US011746451B2

(12) United States Patent
Stingel et al.

(10) Patent No.: US 11,746,451 B2
(45) Date of Patent: Sep. 5, 2023

(54) STITCH-FORMING ELEMENT AND STITCH-FORMING TEXTILE MACHINE

(71) Applicant: Groz-Beckert KG, Albstadt (DE)

(72) Inventors: Uwe Stingel, Meßstetten (DE); Jörg Sauter, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 17/600,434

(22) PCT Filed: Apr. 1, 2020

(86) PCT No.: PCT/EP2020/059304
§ 371 (c)(1),
(2) Date: Sep. 30, 2021

(87) PCT Pub. No.: WO2020/201380
PCT Pub. Date: Oct. 8, 2020

(65) Prior Publication Data

US 2022/0195643 A1 Jun. 23, 2022

(30) Foreign Application Priority Data

Apr. 2, 2019 (EP) ..... 19166731

(51) Int. Cl.
*D04B 15/06* (2006.01)
*D04B 15/24* (2006.01)

(52) U.S. Cl.
CPC ..... *D04B 15/06* (2013.01); *D04B 15/24* (2013.01)

(58) Field of Classification Search
CPC ..... D04B 15/06; D04B 15/24
See application file for complete search history.

(56) References Cited

U.S. PATENT DOCUMENTS 2,403,864 A 7/1946 Larkin
3,377,823 A * 4/1968 McDonough ..... D04B 15/06 66/107

(Continued)

FOREIGN PATENT DOCUMENTS

DE 1180876 B 11/1964
DE 3325103 A1 1/1985

(Continued)

OTHER PUBLICATIONS

European Patent Office; Search Report in related International Patent Application No. PCT/EP2020/059304 dated Jun. 8, 2020; 4 pages.

(Continued)

*Primary Examiner* — Danny Worrell
(74) *Attorney, Agent, or Firm* — Dorton & Willis, LLP

(57) ABSTRACT

A stitch forming element for a stitch-forming textile machine, wherein the textile machine includes a stitch-forming element carrier with at least one guide channel for guiding at least one stitch-forming element. The stitch-forming element includes a longitudinal axis and a vertical axis and a first recess with a lower edge, an upper edge, an open first end and a closed second end for stitch formation. The stitch-forming element further includes a second recess with a lower edge, an upper edge, an open first end and a closed second end for cleaning the at least one guide channel. The stitch-forming textile machine includes a stitch-forming element carrier with at least one guide channel, and at least one such stitching element. The least one stitch-forming element with its second recess is guided in the at least one guide channel.

19 Claims, 3 Drawing Sheets

(56) References Cited

U.S. PATENT DOCUMENTS

| | | | | | |
|---|---|---|---|---|---|
| 5,201,793 | A | * | 4/1993 | Izumi | D04B 35/32 66/168 |
| 5,279,133 | A | * | 1/1994 | Plath | D04B 1/02 66/54 |
| 5,477,707 | A | * | 12/1995 | Renda | D04B 1/123 66/93 |
| 5,564,291 | A | | 10/1996 | Tsai | |
| 6,176,107 | B1 | | 1/2001 | Pernick et al. | |
| 2007/0125131 | A1 | | 6/2007 | Stingel | |

FOREIGN PATENT DOCUMENTS

| | | | |
|---|---|---|---|
| EP | 1793023 | A1 | 6/2007 |
| GB | 2066861 | A | 7/1981 |
| GB | 2177125 | A | 1/1987 |

OTHER PUBLICATIONS

European Patent Office; Search Report in related European Patent Application No. EP 19 16 6731 dated Nov. 20, 2019; 8 pages.
Bangladesh Patent Office; Office Action in related Patent Application No. 140/2020/1095 dated Feb. 11, 2021; 1 page.
Pakistan Patent Office; Office Action in related Patent Application No. 208/2020 dated Dec. 31, 2020; 2 pages.

* cited by examiner

STITCH-FORMING ELEMENT AND STITCH-FORMING TEXTILE MACHINE

CROSS-REFERENCE TO RELATED APPLICATIONS

This application is a national phase application under 35 U.S.C. § 371 of International Patent Application No. PCT/EP2020/059304, filed Apr. 1, 2020 (pending), which claims the benefit of priority to European Patent Application No. EP 19166731.0, filed Apr. 2, 2019, the disclosures of which are incorporated by reference herein in their entirety.

TECHNICAL FIELD

The invention relates to a stitch-forming element for a stitch-forming textile machine, the stitch-forming textile machine having a stitch-forming element carrier with at least one guide channel for guiding at least one stitch-forming element, the stitch-forming element having a longitudinal axis and a vertical axis and a first recess with a lower edge, an upper edge, an open first end and a closed second end for stitch forming, wherein the stitch-forming element has a second recess with a lower edge, an upper edge, an open first end and a closed second end. In addition, the invention relates to a stitch-forming textile machine having a stitch-forming element carrier with at least one guide channel.

BACKGROUND

A circular knitting machine is known from document U.S. Pat. No. 6,176,107 B1 with an exchangeable component for limiting vertical movement of sinkers. The circular knitting machine has a cylinder arrangement with a prestressed limiting component. The pretensioned limiting component is positioned in a composite receiving channel and serves to provide bearing-like surfaces in which the sinkers engage, and thus to limit unwanted vertical movement of the sinkers. The sinkers each have a lower nose with a top surface, a bottom surface and a front edge. The sinkers also each have an upper nose with a top surface, a bottom surface and a front edge. The top surface of the lower nose and the bottom surface of the upper nose delimit a gap. The sinker also has a holding-down protrusion.

From the document DE 3325103 A1 there is known a holding-down sinker for knitting or warp knitting machines which, with its front part which has at least one stitch knock-over edge, for guidance engages longitudinally displaceably in a groove and for control is provided in a sinker support by means of a sinker lock with control feet, in which the area of its underside coming into contact in the groove is delimited on both sides by sharp-edged steps and has a length which is smaller than the sinker stroke, and in which one step belongs to an edge recess which extends up to the control foot in the central area and to which is on the upper side an edge recess on the top side of the sinker is assigned, the edge recess extending from the control foot of the central region to the inner end of the front sinker part, so that between the two edge recesses there is a narrow web of the sinker which gives the control foot of the central area elasticity in the longitudinal displacement direction.

In the holding-down sinker according to document DE 3325103 A1, the contact areas of the holding-down sinker are delimited with sharp edges and dimensioned in such a way that, during a longitudinal adjustment movement of the holding-down sinker, adjustment paths of two delimiting steps overlap, so that it is ensured that in the guide groove for a front part that interacts with needles during the stitch-forming process no dirt can settle, but is pushed out by the sharp-edged steps toward one end or the other of the groove.

From document EP 1 793 023 A1 a knitting machine is known with a needle bed which has a number of channels for receiving knitting tools, with a number of knitting tools which are arranged longitudinally displaceably in the channels of the needle bed and have a working part, with a knitting cam box, which is set up to drive the knitting tools and is arranged adjacent to the needle bed, so that at least one air guidance space is defined between the needle bed and the knitting cam box, and with an air conveyor device which is connected to the air guidance space in order to conduct an air flow therethrough to the working part.

The document GB 2 177 125 A relates to a knock-over sinker for circular knitting machines. The holding-down sinker has a head with two hooks and two knock-over edges. A hook and a knock-over edge form a first recess, a hook and a knock-over edge form a second recess. Both cutouts lie above a comb ring when the knock-over sinker is arranged in a guide channel of the comb ring.

The document GB 2 066 861 A shows a sinker for a circular knitting machine, which has a front part with an obliquely rising lower edge, a nose and an obliquely rising upper edge. Below the nose, the lower edge is continued by an outlet radius. The sinker is mounted in a sinker ring, the sinker ring not being shown and also not being described in detail.

The object of the invention is to improve an above-mentioned stitch-forming structurally and/or functionally. In addition, the object of the invention is to improve an above-mentioned stitch-forming textile machine structurally and/or functionally.

The object is achieved with a stitch-forming element having the features of claim 1. In addition, the object is achieved with a stitch-forming textile machine having the features of claim 8. Advantageous designs and/or further developments are the subject matter of the dependent claims.

The stitch-forming element can have a plate-like shape. The stitch-forming element can have an at least approximately rectangular cross section at right angles to the longitudinal axis. The longitudinal axis and the vertical axis can be arranged at right angles to one another. The stitch-forming element can have a transverse axis arranged relative to the longitudinal axis and to the vertical axis. The stitch-forming element can have a length in the direction of extension of the longitudinal axis. A direction of extension of the longitudinal axis can also be designated as the longitudinal direction. The stitch-forming element can have a height in the direction of extension of the vertical axis. A direction of extension of the vertical axis can also be designated as the vertical direction. The stitch-forming element can have a width in the direction of extension of the transverse axis. A direction of extension of the transverse axis can also be designated as the transverse direction. The height of the stitch-forming element can have a multiple of its width. The length of the stitch-forming element can have a multiple of its height.

The stitch-forming element can be guided and/or displaced in the at least one guide channel. The stitch-forming element can be guided and/or displaced in the longitudinal direction. The stitch-forming element can be drivable. The stitch-forming element can be driven in the longitudinal direction.

The stitch-forming element can have a head section, a first shaft section, a second shaft section and/or a foot section.

The stitch-forming element can have a yarn guide section. The yarn guide section can have a projection-like shape. The yarn guide section can have a yarn guide edge. The yarn guide section can be assigned to the head section. The yarn guide section can be arranged so as to project above the guide channel. The stitch-forming element can be drivable via its shaft section and/or its foot section.

The stitch-forming element can have a first guide section. The first guide section can be assigned to the head section. The first guide section can extend in the vertical direction over that section of the stitch-forming element which is guided into the at least one guide channel of the stitch-forming element carrier when the stitch-forming element is arranged for use on the stitch-forming element carrier. The stitch-forming element can have at least one further guide section in the longitudinal direction adjacent to the first guide section and/or at a distance from the first guide section. The at least one further guide section can be assigned to the shaft section and/or the foot section.

The first recess can serve to grip and/or guide a thread in order to form stitches. The first recess can also be designated as a stitch-forming recess. The first recess can have a slit-like shape. The first recess can be designed similar to an elongated hole open on its short side. The first recess can be delimited in a U-like manner. The first recess can be delimited correspondingly or similarly to a horizontal U. The first end and the second end of the first recess can be spaced apart from one another in the longitudinal direction. The first end of the first recess can be arranged on the head side. The second end of the first recess can be arranged towards the shaft section and/or the foot section. The terms "lower edge" and "upper edge" can refer to an arrangement of the stitch-forming element for use on the stitch-forming element carrier. The lower edge can also be called the first edge. The top edge can also be designated as the second edge. The lower edge and the upper edge of the first recess can be arranged at least approximately parallel to the longitudinal axis. The lower edge and the upper edge of the first recess can be spaced apart from one another in the vertical direction. The lower edge and the upper edge of the first recess can be arranged at least approximately parallel to one another. The stitch-forming element can have a plurality of first recesses.

The second recess can serve to remove dirt, such as abraded fibers, from the at least one guide channel. The second recess can also be designated as a cleaning recess. The second recess can have a slit-like shape. The second recess can be designed similar to an elongated hole open on its short side. The second recess can be delimited in a U-like manner. The second recess can be delimited correspondingly or similarly to a horizontal U. The first end and the second end of the second recess can be spaced apart from one another in the longitudinal direction. The first end of the second recess can be arranged on the head side. The second end of the second recess can be arranged towards the shaft section and/or the foot section. The second end of the second recess can be positioned upstream of the yarn guide section in the longitudinal direction in the direction of the first end. The second end of the second recess can be arranged in the longitudinal direction at least approximately in the region of the yarn guide section.

The terms "lower edge" and "upper edge" can refer to an arrangement of the stitch-forming element for use on the stitch-forming element carrier. The lower edge can also be called the first edge. The top edge can also be designated as the second edge. The lower edge and the upper edge of the second recess can be spaced apart from one another in the vertical direction. At the first end, the lower edge and the upper edge of the second recess have a greater spacing from one another than at the second end. At the second end, the lower edge and the upper edge of the second recess can have a smaller spacing from one another than at the first end. The second recess can be widened from the second end toward the first end. The second recess can be continuously widened from the second end toward the first end.

The stitch-forming element can be a system part. The stitch forming element can be a knitting tool. The stitch-forming element can be a warp knitting tool. The stitch-forming element can be a sinker. The stitch-forming element can be a holding-down and knock-over sinker. The stitch-forming element can be a transfer part. The stitch-forming element can be a selection part. The stitch-forming element can be a coupling part. The stitch-forming element can be a system part with a hold-down part.

The lower edge and the upper edge of the second recess can be arranged at an angle to one another. The lower edge and the upper edge of the second recess can be arranged at an acute angle to one another. The lower edge and the upper edge of the second recess can intersect in their extension. An angle formed between the lower edge and the upper edge of the second recess can be opened towards the first end. The second recess can have an opening angle $\alpha>5$ degrees, in particular $\alpha>10$ degrees, in particular $\alpha$=approx. 12 degrees.

The lower edge of the second recess is arranged at an angle to the longitudinal axis. The upper edge of the second recess can be arranged at least approximately parallel to the longitudinal axis. The upper edge of the second recess can be arranged at an angle to the longitudinal axis.

The second end of the second recess can be arranged in the longitudinal direction upstream of the second end of the first recess on the head section side. The lower edge and the upper edge can end at least approximately one above the other at the first end of the second recess. The lower edge and the upper edge can end at least approximately one above the other in the vertical direction at the first end of the second recess. The lower edge and the upper edge can end at least approximately in the same place in the longitudinal direction at the first end of the second recess.

The lower edge can be straight at least in sections. The upper edge can be straight at least in sections. The lower edge can be curved at least in sections. The upper edge can be curved at least in sections. The lower edge can be designed with steps, at least in sections. The upper edge can be designed in stages at least in sections.

The first recess can be closed at the second end in an arc shape with a small radius and the second recess can be closed at the second end in an arc shape with a large radius. The radius at the second end of the first recess can be small in relation to the radius at the second end of the second recess. The radius at the second end of the second recess can be large in relation to the radius at the second end of the first recess. The radius at the second end of the second recess can be approximately 1.5 times to approximately 3 times, in particular approximately 2 times, the radius at the second end of the first recess. The first recess and the second recess can each be closed in a circular arc at the second end. The first recess and the second recess can each be closed with a transition at the second end between the lower edge and the upper edge. The first recess and the second recess can each be closed at the second end between the lower edge and the upper edge with a transition without edges.

The second recess can be arranged in a lower half of the head section of the stitch-forming element. The second recess can divide the head portion of the stitch-forming element approximately into three.

The stitch-forming element can have at least one further guide section adjoining the first guide section and/or spaced apart from the first guide section in the vertical direction. The at least one further guide section can be arranged in the vertical direction below the first guide section. The first guide section and/or the at least one further guide section can be designed in the manner of a leg. The at least one further guide section can be assigned to an annular groove of the stitch-forming element carrier. The at least one further guide section can serve to engage in the annular groove in order to hold down the stitch-forming element. The at least one further guide section can extend in the vertical direction below that section of the stitch-forming element which is guided into the at least one guide channel of the stitch-forming element carrier when the stitch-forming element is arranged for use on the stitch-forming element carrier.

The stitch-forming textile machine can be a knitting machine. The stitch-forming textile machine can be a circular knitting machine. The stitch-forming textile machine can be a flat knitting machine. The stitch-forming textile machine can be a warp knitting machine. The stitch-forming textile machine can be a circular knitting machine. The stitch-forming textile machine can be a flat warp knitting machine.

The stitch-forming element carrier can have an annular or hollow cylindrical basic shape with a longitudinal axis of the stitch-forming element carrier. The stitch-forming element carrier can have a comb ring. The stitch-forming element carrier can have a sinker ring. The stitch-forming element carrier can have a needle carrier. The at least one guide channel can be arranged on the end face of the stitch-forming element carrier. The at least one guide channel can run radially with respect to the longitudinal axis of the stitch-forming element carrier. The at least one guide channel can be arranged radially on the outside on the stitch-forming element carrier. The at least one guide channel can run parallel to the longitudinal axis of the stitch-forming element carrier. The stitch-forming element carrier can have an annular groove. The annular groove can be arranged radially on the outside on the stitch-forming element carrier. The annular groove can run concentrically circumferentially to the longitudinal axis of the stitch-forming element carrier. The annular groove can serve to hold down the stitch-forming element and to guide it in the circumferential direction of the stitch-forming element carrier.

The at least one guide channel can have a longitudinal axis of the guide channel. The at least one guide channel can have an at least approximately rectangular cross section at right angles to the longitudinal axis of the guide channel. The at least one guide channel can have a guide channel vertical axis. The longitudinal axis of the guide channel and the vertical axis of the guide channel can be arranged at right angles to one another. The at least one guide channel can have a guide channel transverse axis arranged relative to the longitudinal axis of the guide channel and to the vertical axis of the guide channel. The at least one guide channel can have a guide channel length in the direction of extension of the longitudinal axis of the guide channel. A direction of extension of the longitudinal axis of the guide channel can also be designated as the longitudinal direction of the channel. The at least one guide channel can have a guide channel height in the direction of extension of the guide channel vertical axis. A direction of extension of the guide channel vertical axis can also be designated as a channel vertical direction. The at least one guide channel can have a guide channel width in the direction of extension of the guide channel transverse axis. A direction of extension of the guide channel transverse axis can also be designated as a channel transverse direction. The guide channel height can be a multiple of the guide channel width. The guide channel length can be a multiple of the guide channel height.

The longitudinal axis of the stitch-forming element and the longitudinal axis of the guide channel can correspond to one another. The height of the guide section of the stitch-forming element and the guide channel height can correspond at least approximately to one another. The length of the guide channel can correspond at least approximately to a length of the guide section of the stitch-forming element plus a distance between an extended first end position and a retracted second end position of the stitch-forming element. The stitch-forming element can be displaced in the longitudinal direction in the at least one guide channel and can be guided in the transverse direction with as little play as possible.

The at least one guide channel can have a bottom section. The at least one guide channel can have two wall sections. The at least one guide channel can be open towards the bottom section.

The at least one stitch-forming element can be guided and/or displaceable in the longitudinal direction in the at least one guide channel. The at least one stitch-forming element can be guided and/or displaceable between an extended first end position and a retracted second end position. In the second end position the second recess can protrude with its first end in the longitudinal direction over the guide channel. The second recess can also provide access to the at least one guide channel in the second end position. The second end of the second recess can also be arranged in the second end position in front of the guide channel in the longitudinal direction.

Self-cleaning is made possible with the invention. Dirt is removed. Sluggish operation is reduced or avoided. Wear is reduced. Maintenance intervals can be increased. An outlay, such as time consumption, maintenance, cleaning and/or costs, is reduced. Productivity and/or product quality are increased.

Exemplary embodiments of the invention are described in more detail below with reference to figures.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
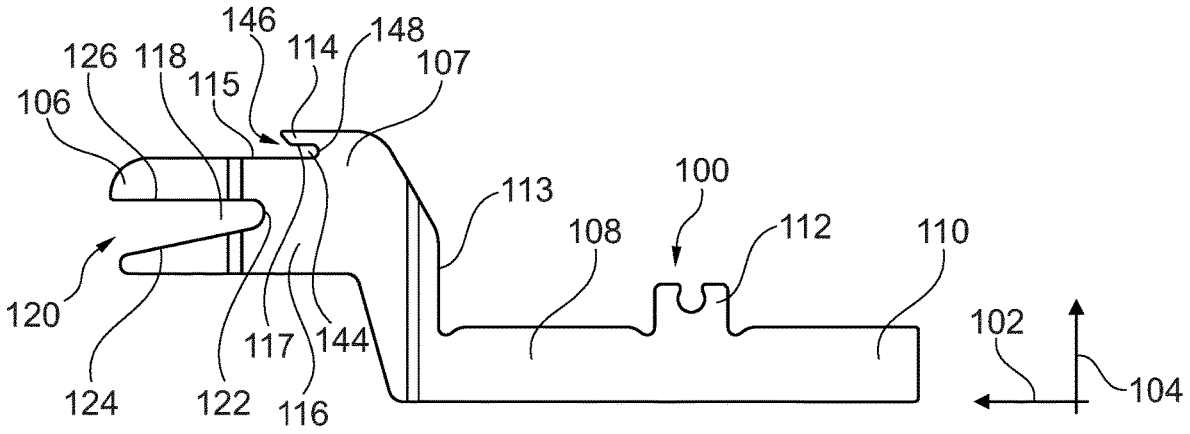
FIG. 1 shows an exemplary stitch-forming element with a cleaning recess.

FIG. 1 shows an exemplary stitch-forming element 100 designed as a holding-down and knock-over sinker in accordance with the principles of the present disclosure. The stitch-forming element 100 is used in a stitch-forming textile machine designed as a knitting machine and can be guided and displaced in a guide channel.

The stitch-forming element 100 has a longitudinal axis 102 and a vertical axis 104, a first head section 106, a second head section 107, a first shaft section 108 and a second shaft section 110. The stitch-forming element 100 has a smaller width on the second head section 107 than on the first head section 106 and on the shaft sections 108, 110. The stitch-forming element 100 has a drive section 112, a drive edge 113, a knock-off edge 115, a projecting yarn guide section 114 with a yarn guide edge 117 and a guide section 116. The drive section 112 and the drive edge 113 serve to introduce a driving force in order to displace the stitch-forming element 100 in the longitudinal direction. The drive edge 113 extends between the head section 106 and the first shaft section 108 in the height direction. The drive section 112 is arranged between the first shaft section 108 and the second shaft section 110. The yarn guide section 114 with the yarn guide edge 117 serves to hold down a yarn and is assigned to the head section 106. The guide section 116 serves to guide the stitch-forming element 100 such that it can be displaced in the longitudinal direction in the guide channel, and is assigned to the head section 106.

The stitch-forming element 100 has a stitch-forming recess 144. The stitch-forming recess 144 serves to grip and/or to guide a thread in order to form stitches. The stitch-forming recess 144 is arranged vertically above the guide section 116 and has an open first end 120 and a closed second end 122 in the longitudinal direction and a lower edge 115 and an upper edge 117 in the vertical direction. The lower edge 115 and the upper edge 117 are each straight and arranged parallel to one another and to the longitudinal axis 102. The stitch-forming recess 144 is closed at the second end 122 in a circular arc with a comparatively small radius.

The stitch-forming element 100 has a cleaning recess 118. The cleaning recess 118 serves to remove dirt, such as abraded fibers, from the guide channel during operation of the textile machine. The cleaning recess 118 is arranged on the guide section 116 and has an open first end 120 and a closed second end 122 in the longitudinal direction and a lower edge 124 and an upper edge 126 in the vertical direction.

The lower edge 124 and the upper edge 126 are each straight, have a greater distance from one another in the vertical direction at the first end 120 and a smaller distance from one another at the second end 122 and are arranged open toward one another with an opening angle $\alpha$=approximately 12 degrees toward the first end 120, so that the cleaning recess 118 is continuously widened from the second end 122 to the first end. The cleaning recess 118 is closed at the second end 122 in a circular arc with a comparatively large radius. The lower edge 124 is arranged at an angle to the longitudinal axis 102, and the upper edge 126 is arranged parallel to the longitudinal axis 102. The second end 122 is upstream of the yarn guide section 114 in the longitudinal direction 102 in the direction of the first end 120.

Figure 2:
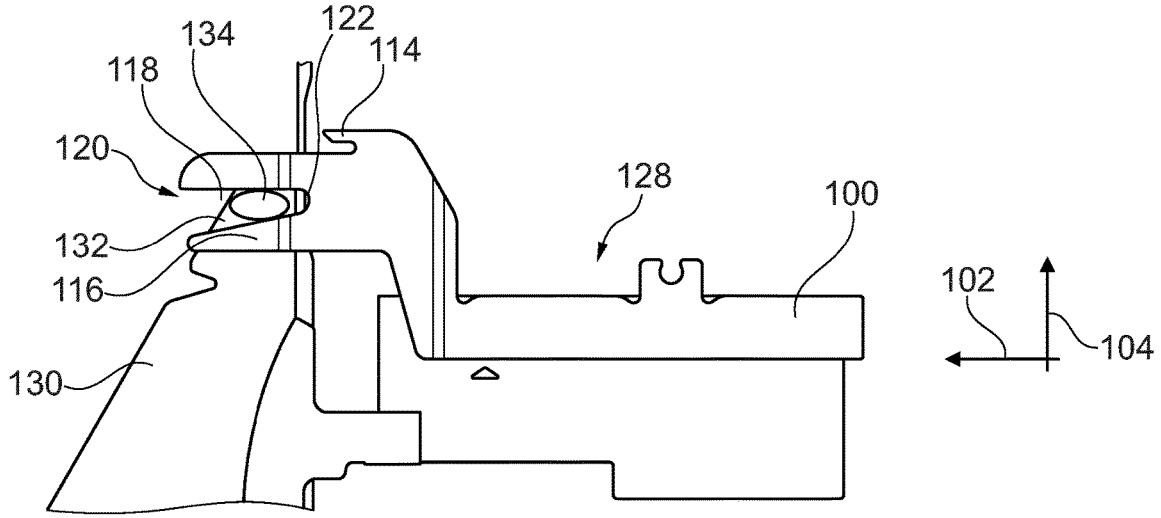
FIG. 2 shows an accumulation of dirt in a cleaning recess of a stitch-forming element.

FIG. 2 shows the stitch-forming element 100 in a stitch-forming textile machine 128 designed as a knitting machine with a stitch-forming element carrier 130. The stitch-forming element carrier 130 has a comb ring with guide channels, such as 132. The stitch-forming element 100 is guided displaceably in the longitudinal direction 102 in the guide channel. The guide channels 132 are arranged on the top of the comb ring at the front and run radially to a longitudinal axis of the stitch-forming element carrier 130.

The guide channels 132 each have a bottom section and two wall sections and are open towards the top of the bottom section. The stitch-forming element 100 is guided with its guide section 116 on the bottom section and between the wall sections of the guide channel. The longitudinal axis 102 of the stitch-forming element 100 and a longitudinal guide channel axis correspond to one another. A height of the guide section 116 of the stitch-forming element 100 and a guide channel height correspond to one another. The knock-over edge 115 and the yarn guide section 114 with the yarn guide edge 117 project above the guide channel 132 in the vertical direction 104, the cleaning recess 118 with the lower edge 124 and the upper edge 126 is arranged inside the guide channel 132.

The stitch-forming element 100 is displaced between an extended first end position and a retracted second end position during operation. As shown in FIG. 2, dirt 134, such as abraded fibers, collects in the cleaning recess 118. In addition, reference is made in particular to FIG. 1 and the associated description.

Figure 3:
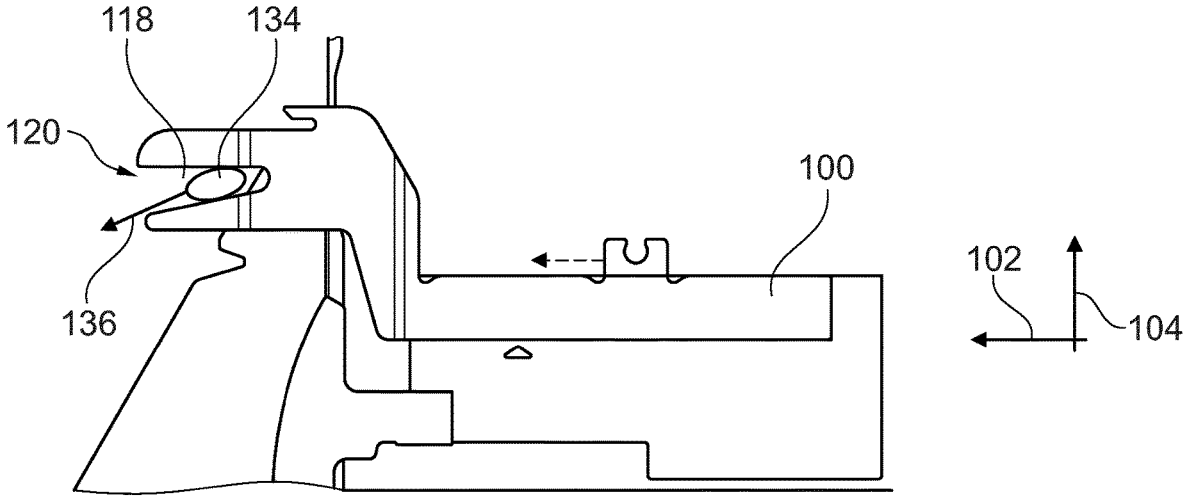
FIG. 3 shows conveying of dirt with the aid of a cleaning recess of a stitch-forming element when the stitch-forming element is displaced in the di-rection of an extended first end position.
Figure 4:
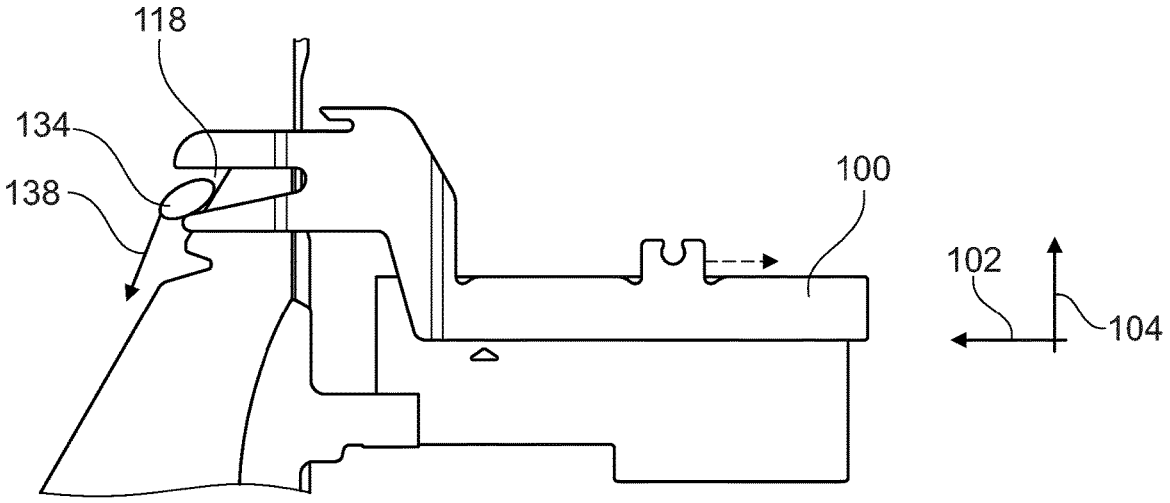
FIG. 4 shows ejection of dirt from a cleaning recess of a stitch-forming element when the stitch-forming element is displaced in the direction of a retract-ed second end position.

In the first end position, the cleaning recess 118 projects with its first end 120 in the longitudinal direction 102 inwards over the guide channel 132. As can be seen from FIG. 3, the dirt 134 is conveyed inward with the aid of the cleaning recess 118 when the stitch-forming element 100 is displaced in the direction of the extended first end position in the direction of the arrow 136 and, as shown in FIG. 4, is ejected from a cleaning recess 118 when the stitch-forming element 100 is displaced in the direction of the second end position in the direction of the arrow 138. The angular arrangement of the lower edge 124 assists ejection downwards. In addition, reference is made in particular to FIGS. 1 to 2 and the associated description.

Figure 5:
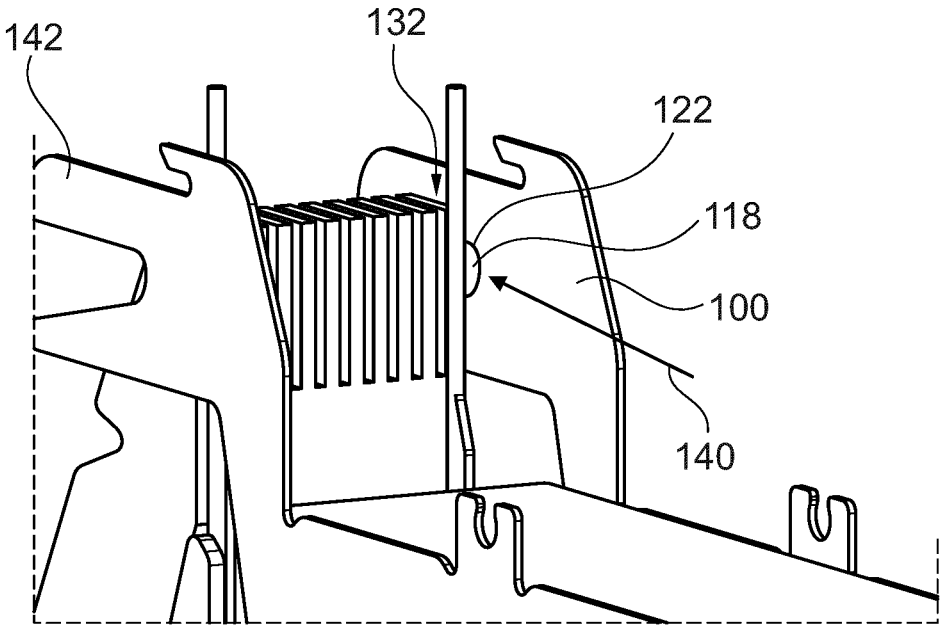
FIG. 5 shows a blowing out of a guide channel with the stitch-forming element displaced into a first end position in a view from the outside.
Figure 6:
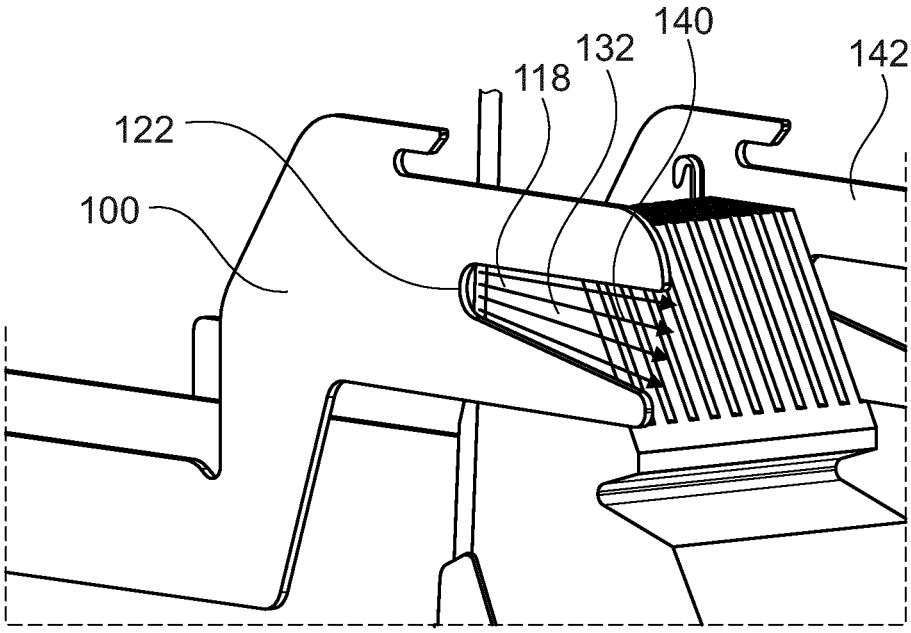
FIG. 6 shows a blowing out of a guide channel with the stitch-forming element displaced into a first end position in a view from the inside.

The second end 122 of the cleaning recess 118 is arranged in the second end position in the longitudinal direction 102 in front of the guide channel 132, so that the cleaning recess 118 in the second end position of the stitch-forming element 100 enables access to the guide channel 132. In this way, the guide channel 132 in the second end position of the stitch-forming element 100 can be acted upon and cleaned, for example, with cleaning air 140. FIG. 5 shows a blowout of the guide channel 132 with the stitch-forming element 100 displaced into the second end position in a view from the outside, and FIG. 6 shows a blowout of the guide channel 132 with a stitch-forming element 100 displaced into the second end position in a view from the inside. FIGS. 5 and 6 also show a stitch-forming element 142 which has been displaced into the first end position. In addition, reference is made in particular to FIG. 1 to FIG. 4 and the associated description.

The word "may" refers in particular to optional features of the invention. Accordingly, there are also further developments and/or exemplary embodiments of the invention which additionally or alternatively have the respective feature or the respective features.

If necessary, isolated features can also be selected from the combinations of features disclosed in the present case and can be used in combination with other features to delimit the subject matter of the claim, while resolving a structural and/or functional relationship that may exist between the features.

While the present invention has been illustrated by a description of various embodiments, and while these embodiments have been described in considerable detail, it is not intended to restrict or in any way limit the scope of the appended claims to such de-tail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

| Reference numerals | |
|---|---|
| 100 | stitch-forming element |
| 102 | longitudinal axis, longitudinal direction |
| 104 | vertical axis, vertical direction |
| 106 | first head section |
| 107 | second head section |
| 108 | first shaft section |
| 110 | second shaft section |
| 112 | drive section |
| 113 | drive edge |
| 114 | yarn guide section |
| 115 | lower edge, knock-over edge |
| 116 | guide section |
| 117 | upper edge, thread guide edge |
| 118 | second recess, cleaning recess |
| 120 | first end |
| 122 | second end |
| 124 | lower edge |
| 126 | upper edge |
| 128 | textile machine |
| 130 | stitch-forming element carrier |
| 132 | guide channel |
| 134 | dirt |
| 136 | arrow direction |
| 138 | arrow direction |
| 140 | cleaning air |
| 142 | stitch-forming element |
| 144 | first recess, stitch-forming recess |
| 146 | first end |
| 148 | second end |

148 second end

What is claimed is:

1. A stitch-forming element for a stitch-forming textile machine, wherein the textile machine includes a stitch-forming element carrier with at least one guide channel for guiding at least one stitch-forming element, the stitch-forming element comprising:

a longitudinal axis, and a vertical axis orthogonal to the longitudinal axis;

a head section and a shaft section arranged on opposite longitudinal ends of the stitch-forming element, wherein the head section defines an upstream direction relative to the shaft section;

a first recess on the head section, the first recess including a lower edge, an upper edge spaced from the lower edge, an open first end, and a closed second end for stitch formation; and a second recess on the head section, the second recess comprising a lower edge, an upper edge spaced from the lower edge, an open first end, and a closed second end;

wherein the lower edge of the second recess is arranged at an angle to the longitudinal axis for cleaning the at least one guide channel; and wherein the second recess defines an opening angle between the upper edge and the lower edge, and the opening angle is greater than 5 degrees.

2. The stitch-forming element of claim 1, wherein the opening angle is greater than 10 degrees.

3. The stitch-forming element of claim 1, wherein the opening angle is approximately 12 degrees.

4. The stitch-forming element of claim 1, wherein the second end of the second recess in the longitudinal direction is arranged upstream of the second end of the first recess on the head section side.

5. The stitch-forming element of claim 1, wherein at least one of the lower edge or the upper edge terminate one above the other at the first end of the second recess.

6. A stitch-forming element for a stitch-forming textile machine, wherein the textile machine includes a stitch-forming element carrier with at least one guide channel for guiding at least one stitch-forming element, the stitch-forming element comprising:

a longitudinal axis, and a vertical axis orthogonal to the longitudinal axis;

a head section and a shaft section arranged on opposite longitudinal ends of the stitch-forming element, wherein the head section defines an upstream direction relative to the shaft section;

a first recess on the head section, the first recess including a lower edge, an upper edge spaced from the lower edge, an open first end, and a closed second end for stitch formation; and a second recess on the head section, the second recess comprising a lower edge, an upper edge spaced from the lower edge, an open first end, and a closed second end;

wherein the lower edge of the second recess is arranged at an angle to the longitudinal axis for cleaning the at least one guide channel;

wherein the first recess is closed at the second end in an arc shape having a first radius;

wherein the second recess is closed at the second end in an arc shape having a second radius; and wherein the second radius is larger than the first radius.

7. The stitch-forming element of claim 1, wherein the second recess is arranged in a lower half of the head section of the stitch-forming element.

8. A stitch-forming textile machine, comprising:

a stitch-forming element carrier with at least one guide channel; and at least one stitch-forming element according to claim 1 received on the stitch-forming element carrier;

wherein the at least one stitch-forming element is guided with its second recess in the at least one guide channel.

9. The textile machine of claim 8, wherein:

the at least one stitch-forming element is guided in the at least one guide channel in the longitudinal direction, between an extended first end position and a retracted second end position; and the second recess in the second end position facilitates access to the at least one guide channel.

10. The stitch-forming element of claim 1, wherein:

the first recess is closed at the second end in an arc shape having a first radius;

the second recess is closed at the second end in an arc shape having a second radius; and the second radius is larger than the first radius.

11. The stitch-forming element of claim 6, wherein the second recess defines an opening angle between the upper edge and the lower edge, and the opening angle greater than 5 degrees.

12. The stitch-forming element of claim 11, wherein the opening angle is greater than 10 degrees.

13. The stitch-forming element of claim 11, wherein the opening angle is approximately 12 degrees.

14. The stitch-forming element of claim 6, wherein the second end of the second recess in the longitudinal direction is arranged upstream of the second end of the first recess on the head section side.

15. The stitch-forming element of claim 6, wherein at least one of the lower edge or the upper edge terminate one above the other at the first end of the second recess.

16. The stitch-forming element of claim 6, wherein the second recess is arranged in a lower half of the head section of the stitch-forming element.

17. A stitch-forming textile machine, comprising:

a stitch-forming element carrier with at least one guide channel; and at least one stitch-forming element according to claim 6 received on the stitch-forming element carrier;

wherein the at least one stitch-forming element is guided with its second recess in the at least one guide channel.

18. The textile machine of claim 17, wherein:

the at least one stitch-forming element is guided in the at least one guide channel in the longitudinal direction, between an extended first end position and a retracted second end position; and the second recess in the second end position facilitates access to the at least one guide channel.

19. A stitch-forming element for a stitch-forming textile machine, wherein the textile machine includes a stitch-forming element carrier with at least one guide channel for guiding at least one stitch-forming element, the stitch-forming element comprising:

a longitudinal axis, and a vertical axis orthogonal to the longitudinal axis;

a head section and a shaft section arranged on opposite longitudinal ends of the stitch-forming element, wherein the head section defines an upstream direction relative to the shaft section;

a first recess on the head section, the first recess including a lower edge, an upper edge spaced from the lower edge, an open first end, and a closed second end for stitch formation; and a second recess on the head section, the second recess comprising a lower edge, an upper edge spaced from the lower edge, an open first end, and a closed second end;

the second recess having a longitudinal extent that is greater than a longitudinal extent of the first recess, whereby the second recess facilitates access to the at least one guide channel in a retracted end position of the at least one stitch-forming element within the at least one guide channel;

wherein the lower edge of the second recess is arranged at an angle to the longitudinal axis for cleaning the at least one guide channel.

* * * * *